US005557062A

United States Patent [19]

MacLaren et al.

[11] Patent Number: 5,557,062

[45] Date of Patent: Sep. 17, 1996

[54] BREATHABLE GAS GENERATORS

[75] Inventors: Richard O. MacLaren, Sunnyvale; Donald D. Tzeng, San Jose, both of Calif.

[73] Assignee: United Technologies Corporation, Hartford, Conn.

[21] Appl. No.: 355,391

[22] Filed: Dec. 13, 1994

[51] Int. Cl.[6] ..... C06B 31/28

[52] U.S. Cl. ..... 149/46; 149/61; 149/76; 149/77; 149/83

[58] Field of Search ..... 149/46, 61, 76, 149/77, 83

[56] References Cited

U.S. PATENT DOCUMENTS

| | | | |
|---|---|---|---|
| 792,511 | 6/1905 | Frank . | |
| 2,159,234 | 5/1939 | Taylor | 52/14 |
| 2,707,695 | 5/1955 | Courtier | 167/10 |
| 2,988,437 | 6/1961 | Stanley et al. | 52/15 |
| 3,348,985 | 10/1967 | Sindler et al. | 149/2 |
| 3,865,660 | 2/1975 | Lundstrom | 149/35 |
| 3,883,373 | 5/1975 | Sidebottom | 149/6 |
| 3,912,561 | 10/1975 | Doin et al. | 149/35 |
| 3,947,300 | 3/1976 | Passauer et al. | 149/35 |
| 4,078,954 | 3/1978 | Bernardy | 149/19.8 |
| 4,128,996 | 12/1978 | Garner et al. | 60/205 |
| 4,152,891 | 5/1979 | Garner | 60/205 |
| 4,386,979 | 6/1983 | Jackson, Jr. | 149/21 |
| 4,834,817 | 6/1989 | Zeuner et al. | 149/35 |
| 4,865,667 | 9/1989 | Zeuner et al. | 149/22 |

FOREIGN PATENT DOCUMENTS

| | | |
|---|---|---|
| 0607446 | 7/1994 | European Pat. Off. . |

*Primary Examiner*—Charles T. Jordan
*Assistant Examiner*—Anthony Chi
*Attorney, Agent, or Firm*—Alan C. Cohen

[57] ABSTRACT

The present invention describes a pyrotechnic gas generating composition which upon reaction produces a breathable gas. The composition comprises a fuel, an oxidizer and a nitrogen source and can be useful in inflating passive restraint air bags for vehicles. Also disclosed is a method for inflating a passive restraint safety bag with a breathable gas composition of the subject invention.

8 Claims, No Drawings

BREATHABLE GAS GENERATORS

CROSS REFERENCE TO RELATED APPLICATIONS

Some of the matter disclosed and claimed herein is also disclosed in the following commonly owned, copending U.S. application Ser. No. 08/355,385 filed on even date herewith by MacLaren et al, entitled "Condensable Gas Generator."

TECHNICAL FIELD

The technical field to which this invention pertains to is gas generators, in particular, those gas generators useful in air bag restraint mechanisms.

BACKGROUND OF THE INVENTION

Gas generators have been used for inflation of air bag restraint systems for some time. Those systems which are currently being used employ metal azide-based gas generators to produce the gas for inflating the air bag. The resulting gas generated by these azide based compositions is not suitable as a life sustaining gas. It lacks sufficient oxygen. Such gas generators are suitable for those gas bags used in the drivers side and passenger side air bags in conventional automobiles as the air contained in the passenger compartment is sufficient to dilute the gas products generated by a factor of about four to one or greater. Thereby minimizing the negative impact such gas might have on the occupants when the gas is released into the compartment. Typically, the resulting oxygen in the compartment will be reduced to between 16% to about 18% by volume. This is still suitable for sustaining life but well below the standard concentration of oxygen in air, which is about 21% by volume.

Another problem with the metal azide-based gas generators is the toxicity of these materials which has been a major deterrent to consideration in this type of inflation system for continued use for automobiles and for future use in aircraft.

Various attempts have been made to define an alternative gas generator that does not employ metal azides and yet produces a non-toxic gas mixture. In effect, none have been developed which produce a gas that will sustain life over a protracted period. Many of the suggested alternative generators produce appreciable carbon dioxide, carbon monoxide or unburned hydrocarbons, with and without the simultaneous formation of oxygen, making them unsuitable for breathing.

Therefore, what is needed in this art is a gas generator using non-hazardous components, yet is capable of meeting the requirements for inflating air bag restraint systems while producing a non-toxic, life-sustaining gas.

DESCRIPTION OF THE INVENTION

The present invention is for a gas generating composition comprising a fuel and an oxidizer and an oxygen/nitrogen adjuster, wherein upon combustion the resulting gas mixture contains oxygen and nitrogen approximating the ratio of air.

In addition, this invention also discloses a method for inflating an inflatable air bag restraint comprising the step of substantially or completely inflating the air bag with the gaseous combustion products of a gas generating composition. The gas generated by the combustion of the gas generating composition having [about 20 to 40 volume percent oxygen] and [about 55 to 80 volume percent] nitrogen present approximating the ratio of air.

Other aspects of the invention will become clear in view of the following additional disclosure.

BEST MODE FOR CARRYING OUT THE INVENTION

The basic composition of the present invention comprises a fuel and an oxidizer and a nitrogen/oxygen adjuster, the composition of which, upon combustion, generates a gas product containing substantially oxygen, nitrogen and carbon dioxide in which the oxygen present is about 20 vol % to about 40 vol % and the nitrogen gas present is about 55 vol % to about 80 vol %.

The fuels used in the present invention are materials having the formula $C_n H_m N_p O_r$ wherein n=1 or more, m=1 or more, $p \geqq 2 \times n$ and $r = \phi$ or more. Materials of this type include azodicarbonamide, cyanamides or cyanamide derivatives, in particular, dicyandiamide, cyanomelamine, melamine and disodium cyanamide. Upon combustion with the oxidizer these materials will produce nitrogen gas. These materials may be used singly or in mixtures of one another. These materials are generally present in amounts ranging from 3 wt % to about to about 20 wt % of the gas generating composition, depending on the fuel selected and the oxidizer used. It is desirable that the cyanamide or cyanamide derivative have a low carbon content to reduce the amount of carbon dioxide or carbon monoxide which may result from the combustion of the gas generating composition. As these fuels are responsible for supplying nitrogen gas to the gaseous combustion products of the gas composition, the particular fuel and the amount present in the gas generating composition will depend on the particular oxidizer selected and whether or not additional ingredients are added to the composition (i.e., additional nitrogen generators). Naturally, the analysis and selection of a fuel to be combined with a specific composition is easily made by thermodynamic chemical analysis. In addition, although the compositions may be described herein using only a single fuel material, it should be noted that it is possible to use a combination of two or more such fuels in preparation of a gas generating composition.

The oxidizers, useful in the practice of this invention, are the nitrate and nitrite salts or salts of perchlorate or chlorate, in particular, their potassium and sodium salts, and dinitroamide salts of alkali and alakaline metals and ammonium. However, other oxidizers which are compatible with the other ingredients, and which result in the production during combustion, of the desired oxygen level may also be used. The oxidizer selected must be capable of reacting with the fuel during the combustion process to produce the oxygen gas. Upon combustion, the oxidizer typically supplies a portion of the oxygen gas. Upon combustion, the oxidizer typically supplies a portion of the oxygen of the resulting gas products of combustion. In addition, this oxidant may also produce, during combustion, a condensed byproduct of alkali metal oxide (for instance, sodium oxide or potassium oxide). These oxides will combine with the carbon dioxide gas produced during combustion to form metal carbonates which will remain within the combustion canister. It is desirable, although not mandatory, to select an oxidizer which will produce very little water upon reaction to attain a low temperature exhaust. Such materials are conventional and readily determinable by one skilled in the art.

The oxidizer is generally present in the gas generating composition, in amounts from about 40 wt % to about 75 wt %. However, the actual amount will depend on the specific oxidizer used and the amount of fuel used in the gas generating composition. In addition, it may be desirable to use as the oxidizer a mixture of two or more oxidizing materials to optimize the oxygen gas level resulting from the combustion of the gas generating composition. Naturally, the process for determining the actual amounts needed for the oxidizer or the gas generation system in general may be determined using standard thermochemical combustion calculations.

Other materials may be added to adjust or alter the composition of the gaseous combustion products, reduce or eliminate undesirable byproducts of the combustion or make manufacturing of the composition easier.

One additive which may be added to the fuel and oxidant is a nitride as an additional source of nitrogen for the resulting composition. The function of the nitride material is to adjust the nitrogen-oxygen ratio of the resulting combustion gas products. This adjustment is achieved by the nitride reacting with the oxygen, which is produced during combustion, to produce additional free nitrogen gas while simultaneously reducing the oxygen. An example of such a reaction where silicon nitride is used as the nitride material is set forth below:

$$3O_2+Si_3N_4 \rightarrow 2N_2+3SiO_2 \quad (1)$$

$$SiO_2+Na_2O \rightarrow Na_2SiO_3 \quad (2)$$

The preferred nitride is silicon nitride; however, other nitride materials may be used, such as magnesium nitride or aluminum nitride.

Also, depending on the composition of the gas generating composition, volatile alkali metal oxides may be produced. To eliminate these metal oxides, one may add a metal oxide of aluminum such as aluminum oxide or silicon oxide for the purpose of reacting this material with any excess sodium or potassium oxide generated during combustion. The resulting aluminate (i.e.: $NaAlO_2$) or silicate (i.e.; $Na_2SiO_3$) will eliminate the more volatile alkali metal oxides from the exhaust gas. Generally, these materials will be present in the amount of about 5 wt % to about 25 wt %.

The amount of aluminum oxide or silicon oxide needed varies, depending upon the oxidizer used. Typically, this will be about 3 wt % to about 10% from low concentrations (3–10 wt % ) for chlorate or perchlorate formulations to as much as between 20–40 wt % for nitrite or nitrate formulations.

In preparing the gas generating composition, the mole percent of each ingredient should be present in sufficient quantity to react with the other ingredients to produce the resulting desired gas composition. The resulting gas equivalents of each of the composition may be determined from the reactions which will take place during combustion and would be known to those skilled in this art.

Other incidental materials may be added to the basic fuel, oxidizer and nitrogen contributor, to give the gas generating composition color (to permit identification of substantial homogeneity of the composition) such as carbon, which also increases opacity of the composition.

These gas generating compositions are typically prepared as substantially homogenous mixtures of the different materials. Once the composition is substantially homogenous it may be formed into pellets which are then loaded into the combustion canister of a passive restraint system having a deflated air bag.

Substantial homogeneity of the gas generating compositions may be achieved by a number of conventional mixing techniques. These include methods which add a diluent to the materials and form a slurry which is then mixed to substantial homogeneity using any of the aforementioned conventional methods. Of course, if a diluent is used, the diluent will need to be removed which can be achieved by heating the gas generating composition to evaporate the diluent. This may leave the gas generating composition in a compact or cake-like state at which point it may be fractured into particles of a desired size prior to forming the pellet to be placed in the canister.

In most cases, the ingredients would be formed into a slurry using a methanol diluent, stirred by hand to achieve substantial homogeneity and then dried in an oven to evaporate the diluent. This resulted in a cake-like material which was then crushed to produce particles in the range of 850 micron to 250 micron.

EXAMPLE 1

This example is for a basic formulation for a gas generating composition which meets the criteria for a breathable gas composition in having sufficient oxygen for life-support and a nitrogen-to-oxygen ratio approximating that of air:

| Component | Formula | Wt-% |
|---|---|---|
| Melamine | $C_3N_6H_6$ | 13.7 |
| Sodium Chlorate | $NaClO_3$ | 51.1 |
| Carbon black | C | 0.1 |
| Calcium carbonate | $CaCO_3$ | 17.3 |
| Aluminum oxide trihydrate | $Al_2O_33H_2O$ | 12.4 |
| Silicon nitride | $Si_3N_4$ | 5.4 |

The resulting gas composition from the combustion of these ingredients would be as follows:

| Component | Moles/100 g | Mole % Total | Mole % without $H_2O$ or $CO_2$ |
|---|---|---|---|
| $N_2$ | 0.403 | 25.7 | 79.0 |
| $O_2$ | .107 | 6.8 | 21.0 |
| $H_2O$ | .551 | 35.2 | — |
| $CO_2$ | .507 | 32.3 | — |
| NOx | <.001 | — | — |

The gas generated by this composition would contain water vapor that will condense under most use conditions and carbon dioxide that can be minimized by altering the formulation (as described below) or by using absorbers in the air bag system.

EXAMPLE 2

Sodium nitrate could be substituted for some of the sodium chlorate and calcium carbonate in the above formulation. This substitution provides for a reduction in carbon dioxide gas generated by the combustion of the composition.

| Component | Formula | WT-% |
|---|---|---|
| Melamine | $C_3N_6H_6$ | 13.7 |
| Sodium Chlorate | $NaClO_3$ | 14.2 |
| Carbon Black | C | 0.1 |
| Calcium Carbonate | $CaCO_3$ | 2.3 |
| Aluminum Oxide Trihydrate | $Al_2O_33H_2O$ | 11.9 |
| Silicon Nitride | $Si_3N_4$ | 9.8 |
| Sodium Nitrate | $NaNO_3$ | 48.0 |

The resulting gas composition calculated for this modified formulation would be:

| Component | Moles/100 g | Mole % (Total) | Mole % (Without $H_2O$ or $CO_2$) |
|---|---|---|---|
| $N_2$ | 0.7478 | 40.2 | 79.0 |
| $O_2$ | .1992 | 10.7 | 21.0 |
| $H_2O$ | .5542 | 29.9 | — |
| $CO_2$ | .3573 | 19.2 | — |
| Nox | .0003 | <0.1 | <0.1 |

The $N_2/O_2$ ratio for this composition is equivalent to that of standard air. The carbon dioxide concentration in the gas is also appreciably reduced.

EXAMPLE 3

A formulation of the same family as examples 1 and 2 using dicyandiamide as the fuel is shown below:

| Component | Formula | WT-% |
|---|---|---|
| Dicyandiamide | $C_2H_4N_4$ | 5.3 |
| Sodium Nitrite | $NaNO_2$ | 64.5 |
| Aluminum Oxide | $Al_2O_3$ | 4.5 |
| Sodium Chlorate | $NaClO_3$ | 10.5 |
| Silicon Nitride | $Si_3N_4$ | 15.2 |

The expected resulting gas composition from the combustion of this composition would be:

| Component | Moles/100 g | Mole % (With $H_2O$) | Mole % (Without $H_2O$) |
|---|---|---|---|
| $CO_2$ | .0301 | 2.4 | 2.6 |
| $H_2O$ | .1228 | 9.4 | |
| $N_2$ | .8096 | 62.4 | 68.9 |
| $O_2$ | .3344 | 25.8 | 28.5 |
| NOx | .0010 | <0.1 | <0.1 |

The gas generated by this composition should contain water vapor that will condense under most use conditions to provide the composition in the far right column. This gas provides an oxygen level of about 28 mole % which is within the range of that in air of about 21 moles %. The carbon dioxide level of 2.4% is below the long term threshold value of 3.5%.

EXAMPLE 4

A fourth pyrotechnic composition can be created by using the following composition to produce a water-free gas:

| Component | Formula | WT-% |
|---|---|---|
| Sodium Cyanamide | $Na_2CN_2$ | 10.2 |
| Sodium Nitrite | $NaNO_2$ | 48.5 |
| Sodium Chlorate | $NaClO_3$ | 24.9 |
| Silicon Nitride | $Si_3N_4$ | 16.4 |

The resulting gas composition from the reaction of this composition was:

| Component | Moles/100 g | Mole % |
|---|---|---|
| $CO_2$ | .0001 | 0.01 |
| $N_2$ | .7021 | 66.7 |
| $O_2$ | .3477 | 33.1 |
| NOx | .0020 | 0.2 |

This composition also provides a very low carbon dioxide concentration with a high concentration of oxygen. Consequently, the composition of this gas will be life sustaining without any harmful side effects.

These are four embodiments of compositions of the present invention; however, other compositions will be obvious from this teaching. In addition, certain modifications may be made to the basic composition to achieve a particular result. For instance, in the composition of Example 3, which produces a higher NOx concentration than desired, this concentration can be reduced by the introduction of a coolant ingredient such as sodium chloride or potassium chloride. These compositions are very useful in deploying air bag safety devices in automobiles or in those small space environments where the amount of life-sustaining air is present. As these material produce adequate oxygen in proper balance with nitrogen, they do not present a safety hazard either from a fire standpoint (excessive Oxygen) or inhalation (insufficient oxygen).

We claim:

1. A gas generating composition comprising about 3 wt % to about 20 wt % of a fuel, about 40 wt % to about 75 wt % of an oxidizer and about 5 wt % to about 25 wt % of a nitrogen producing component wherein the gas generated from the combustion of the composition produces a breathable gas composition having an oxygen content of about 20 to about 40 volume percent oxygen and about 60 to about 80 volume percent nitrogen and wherein the nitrogen producing component is present in sufficient mole percent such that the additional nitrogen gas generated by the nitrogen producing component results in a gas composition having the desired nitrogen/oxygen levels.

2. The gas composition of claim 1 wherein the gas generating composition comprises a fuel selected from the group consisting of azodicarbonamide, cyanamides, dicyandiamide, cyanomelamine, melamine and their derivatives and wherein the oxidizer is selected from the group consisting of the salts of nitrates, nitrites, chlorates and perchlorates and dinitroamide salts of alkaline metals and ammonium and a nitrogen producing component is selected from the group consisting of silicon nitride, magnesium nitride and aluminum nitride.

3. The composition of claim 1 wherein the composition further contains about 5 wt % to about 25 wt % of Group III or IV metal oxides.

4. The composition of claim 1 wherein the fuel is selected from the group consisting of materials with the formula $C_n H_m N_p O_r$ wherein n=1 or more, m=1 or more, p=2×n and r=1 or more, and wherein the oxidant is selected from the group consisting of the salts of nitrates, nitrites, chlorates and perchlorates and dinitroamide salts of alkali and alkaline metals and ammonium.

5. A method of inflating an air bag restraint comprising causing a gas generator to be activated thereby creating a gas composition sufficient to inflate the air bag with a breathable gas composition having an oxygen content of about 20 to about 40 volume percent oxygen and about 60 to about 80 volume percent nitrogen and wherein the gas generating composition comprises about 3 wt % to about 20 wt % of a fuel, about 40 wt % to about 75 wt % of an oxidizer and about 5 wt % to about 25 wt % of a nitrogen producing component wherein the nitrogen producing component is present in sufficient mole percent such that the additional nitrogen gas generated by the nitrogen producing component results in a gas composition having the desired nitrogen/oxygen levels.

6. The method of claim 5 wherein the gas generating composition comprises a a fuel selected from the group consisting of azodicarbonamide, cyanamides, dicyandiamide, cyanomelamine, melamine and their derivatives and wherein the oxidizer is selected from the group consisting of the salts of nitrates, nitrites, chlorates and perchlorates and dinitroamide salts of alkaline metals and ammonium and a nitrogen producing component is selected from the group consisting of silicon nitride, magnesium nitride and aluminum nitride.

7. The composition of claim 6 wherein the fuel is selected from the group consisting of materials with the formula $C_nH_mN_pO_r$ wherein n=0 or more, m=1 or more, $p \geqq 2 \times n$ and r=1 or more, and wherein the oxidant is selected from the group consisting of the salts of nitrates, nitrites, chlorates and perchlorates and dinitroamide salts of alkali and alkaline metals and ammonium.

8. The method of claim 6 wherein the pyrotechnic composition comprises:

a. a fuel;

b. an oxidizer which will produce oxygen upon reaction with the fuel;

c. a secondary oxygen source; and d. a nitrogen source.

* * * * *